United States Patent [19]

Gero et al.

[11] Patent Number: 5,023,986

[45] Date of Patent: Jun. 18, 1991

[54] METHOD OF MANUFACTURING A WAVE SCREEN PLATE

[75] Inventors: William Gero, Lanesboro; Frank Paskowski, Pittsfield, both of Mass.

[73] Assignee: Beloit Corporation, Beloit, Wis.

[21] Appl. No.: 510,332

[22] Filed: Apr. 17, 1990

Related U.S. Application Data

[62] Division of Ser. No. 206,151, Jun. 10, 1988, Pat. No. 4,954,249.

[51] Int. Cl.[5] ..... B07B 1/18

[52] U.S. Cl. ..... 29/163.6; 209/397; 209/273

[58] Field of Search ..... 209/397, 398, 399, 273; 29/163.6, 163.7, 457

[56] References Cited

U.S. PATENT DOCUMENTS

| | | | |
|---|---|---|---|
| 520,571 | 5/1894 | Phillips . | |
| 1,082,855 | 12/1913 | Dull . | |
| 2,246,669 | 6/1941 | Cowan . | |
| 2,311,813 | 8/1939 | Beck et al. . | |
| 2,617,600 | 11/1952 | Cole . | |
| 2,827,169 | 12/1954 | Cusi . | |
| 3,339,731 | 4/1964 | Merges et al. . | |
| 3,581,893 | 6/1971 | Rich . | |
| 4,077,247 | 3/1978 | Stewart | 29/163.6 X |
| 4,885,090 | 12/1989 | Chupka et al. | 209/397 X |
| 4,918,807 | 4/1990 | Freijborg | 209/397 X |

FOREIGN PATENT DOCUMENTS

| | | |
|---|---|---|
| 18957 | 6/1914 | Denmark . |
| 25742 | 6/1883 | Fed. Rep. of Germany . |
| 39216 | 11/1886 | Fed. Rep. of Germany . |
| 561779 | 9/1932 | Fed. Rep. of Germany . |
| 148308 | 5/1981 | Fed. Rep. of Germany . |
| 1360820 | 12/1987 | U.S.S.R. . |
| 519680 | 4/1940 | United Kingdom . |
| 2195911 | 4/1988 | United Kingdom . |

*Primary Examiner*—Timothy V. Eley
*Assistant Examiner*—C. Richard Martin
*Attorney, Agent, or Firm*—Dirk J. Veneman; Raymond W. Campbell

[57] ABSTRACT

A paper pulp screening apparatus wherein a modular cylindrically-shaped screen plate is formed of a thin material of uniform thickness bent to form an undulating shape to increase the screening area, and the screen plate is supported by cylindrical-backing members to give the plate strength, with the plate being formed into various complex shapes. Manufacturing methods for forming the undulating shapes are disclosed.

7 Claims, 9 Drawing Sheets

FIG.14
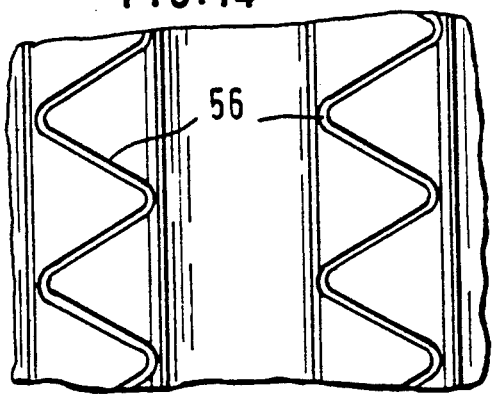
FIG.15
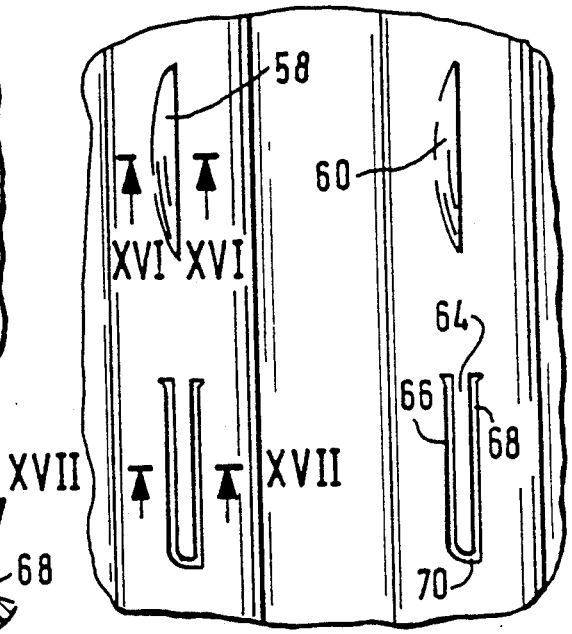
FIG.16
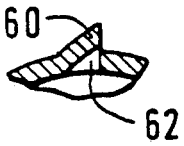
FIG.17
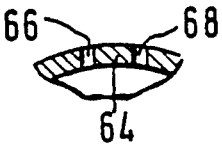
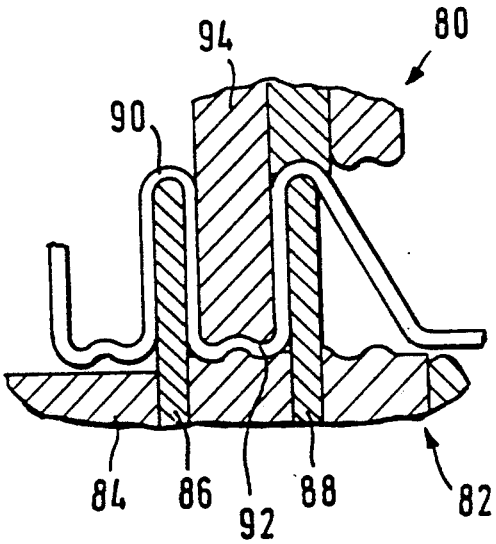
FIG.18
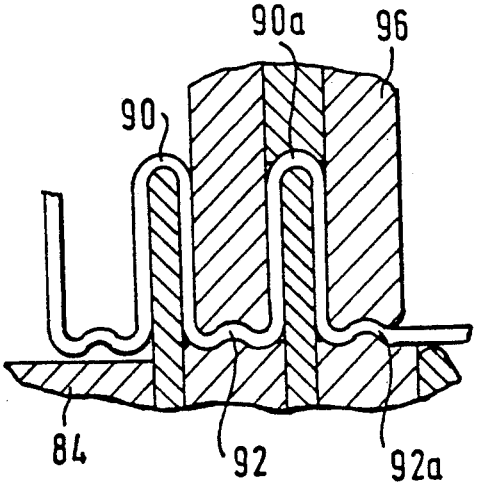
FIG.19

FIG. 20
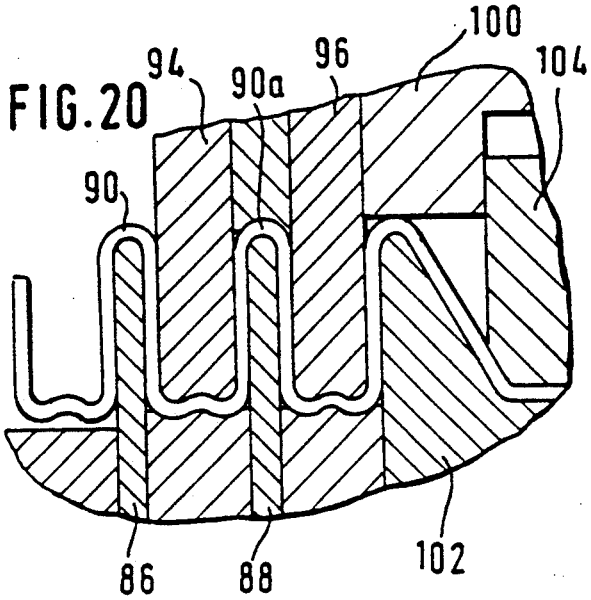
FIG. 21
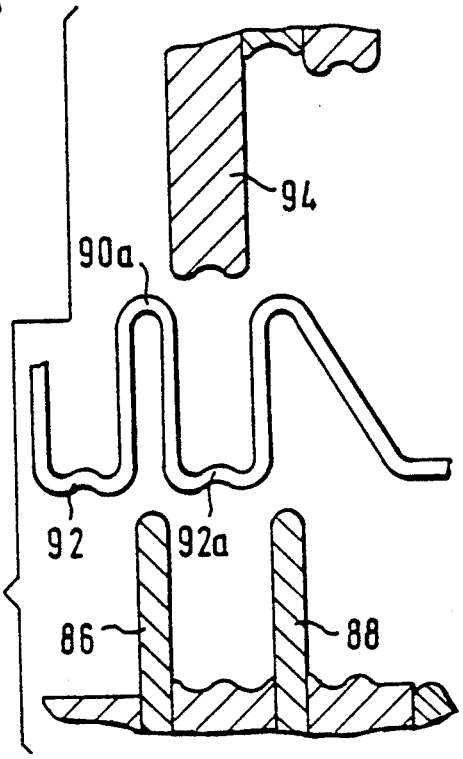
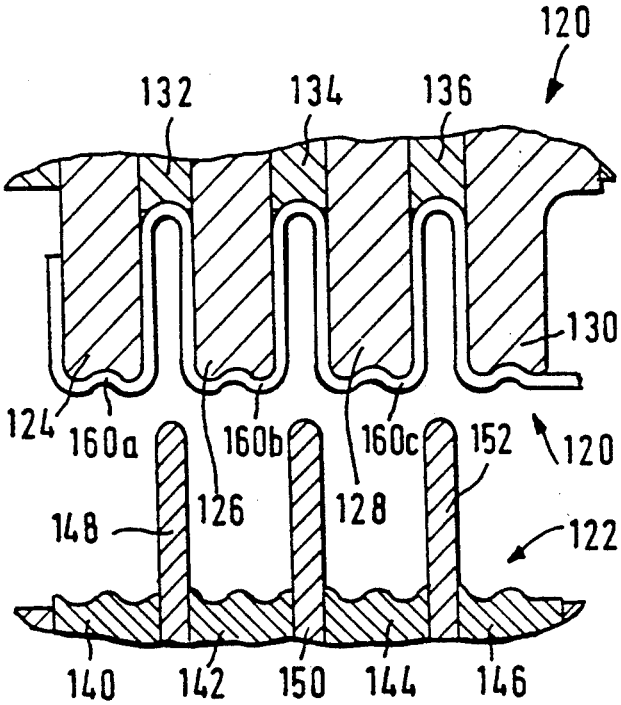
FIG. 22

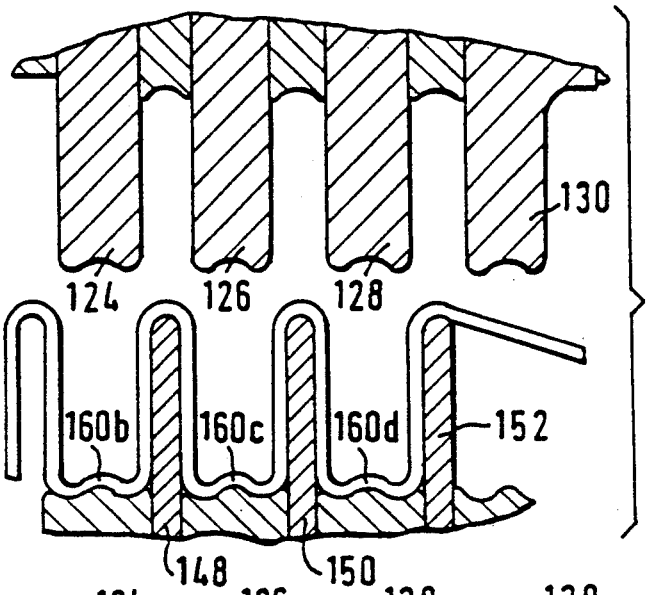
FIG. 26
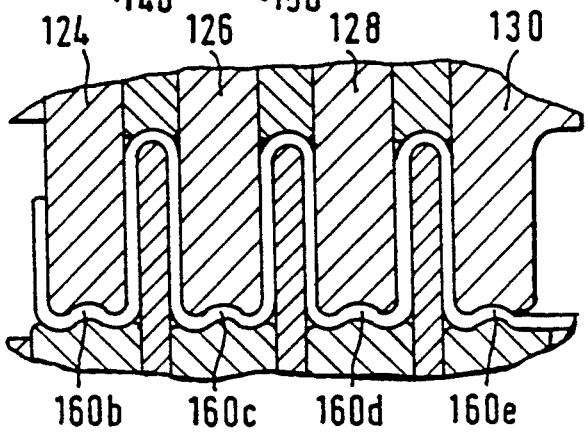
FIG. 27
FIG. 28
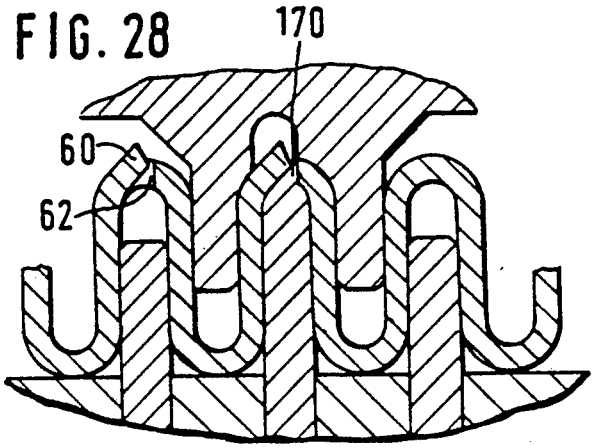
FIG. 29
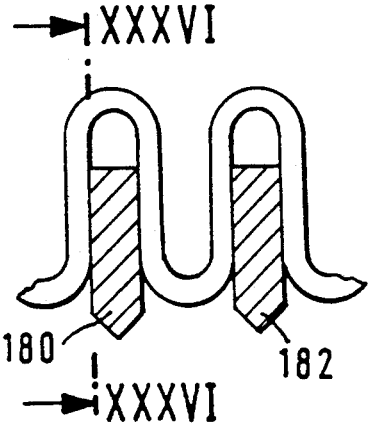

FIG.30
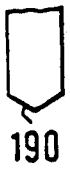
FIG.32
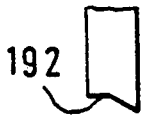
FIG.31
FIG.34
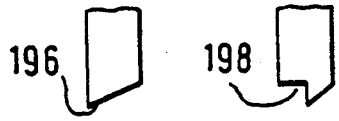
FIG.33
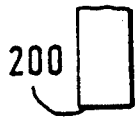
FIG.35
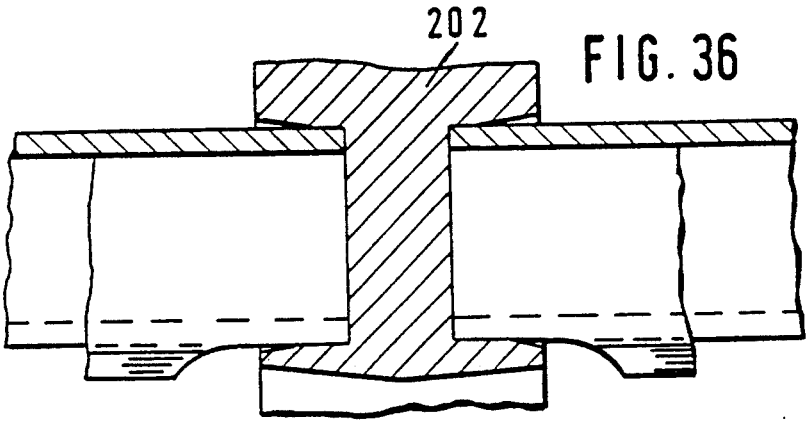
FIG. 36
FIG. 37
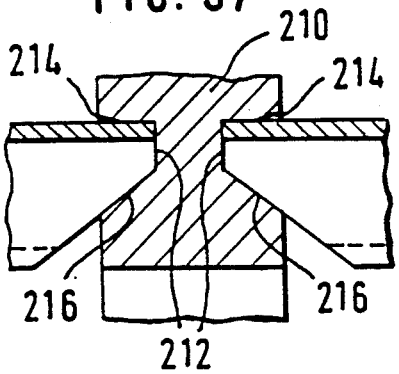
FIG. 38
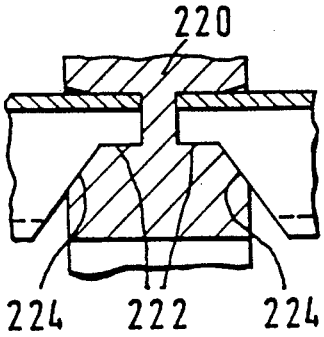
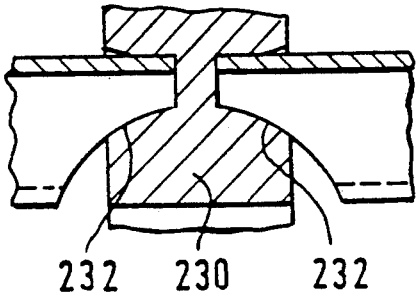
FIG.39

METHOD OF MANUFACTURING A WAVE SCREEN PLATE

This application is a division of application Ser. No. 07/206,151, filed June 10, 1988 now U.S. Pat. No. 4,954,249.

BACKGROUND OF THE INVENTION

The present invention relates to improvements in apparatus for processing wood pulp and other fibrous fluid suspensions, and methods for manufacturing the apparatus More particularly, the apparatus and methods relate to an improved screen for wood pulp, for removing foreign particles from a pulp slurry.

In processing wood pulp, screens are utilized to separate acceptable fiber from unacceptable constituents in a slurry. In a typical screen, the slurry flows through a perforate, cylindrical screen plate, which may be smooth, or which may present a contoured surface toward the stock flowing through the screen, to increase the effective screening area. The screen plate openings are formed in different hole or hole and slot combinations for optimizing screening performance To aid in passage of the acceptable pulp through the screen plate, and to avoid plugging, pulsations are generated in the slurry such as by passing a hydrofoil-shaped member past the screen plate In order to give the screen plate strength to withstand the pressure differential across the surface, and to increase the screening capacity by presenting increased screening area, it has generally been the practice to provide a thickly-walled screen plate which is machined to present the desired surface. Machining the desired contour has required a time consuming and expensive process Because of manufacturing restrictions in the machining process imposed at least in part by the machine tools themselves, total available open accepts flow area has been limited in known screen plates, and the final shape of the screen plate has been a compromise between the limitations of machining and the desired optimum screen shape.

In addition to the expensive costs of production and manufacturing, the type of screen described has been expensive to use and maintain in that, even if only a small area of screen is damaged, the entire screen plate, which includes the screening surface, mounting surfaces and support members must be replaced, thereby presenting a costly operating expense.

An additional problem encountered in operating screens using known screen plates is premature wear due to contaminants. In recycling waste paper, contaminants such as metals, sand, plastic, and glass are often present, and screen plates utilized to remove these contaminants experience rapid wear. In some instances, screen plates have been known to last less than seven days before failure has occurred When heretofore known screen plates are used in such screens, the cost and time required for screen plate replacement is significant.

It is, accordingly, an object of the present invention to provide a screening apparatus and a screen plate design wherein the necessity of an expensive machining manufacturing process is eliminated.

A further object of the present invention is to provide a screen plate structure wherein various modifications and alternatives of screen plate shape can be attained without prohibitive manufacturing costs, and wherein contours can be utilized which were heretofore not considered possible because of manufacturing limitations.

A further object of the present invention is to provide a screen plate structure wherein, for a given screen plate area, increased screening capacity is possible for increased throughput pulp screening rates, and wherein a variety of sizes and shapes are possible for the screen plate openings.

Another object of the present invention is to provide a screen plate forming process and a screen plate structure which can utilize relatively thin material to produce an aggressive profile for increasing the hydraulic capacity of the screen.

Yet another object of the present invention is to provide a modular screen plate structure which simplifies screen plate changing and which eliminates the need to change an entire screen plate when only a portion of the plate is damaged or worn.

A still further object of the present invention is to provide a screen plate structure and manufacturing process therefor which substantially reduce the manufacturing costs of a screen plate while improving the screening efficiency and throughput thereof.

Still another object of the present invention is to provide a screen plate structure and method of manufacturing which is more resistant to abrasive wear than heretofore known screen plates, thereby increasing the useful life of the screen plate when screening slurries containing highly abrasive contaminants.

FEATURES OF THE INVENTION

In accordance with the concepts and objects of the invention, a screen plate is presented wherein relatively thin material is formed into a desired shape or contour, and the screen shape is formed in predetermined lengths and assembled into a modular type assembly. Forming the contours can be performed by stamping, pressing, or other bending techniques not requiring machining.

The various shapes or contours into which the material is formed provide mechanical strength and rigidity, which allow using thinner material than that previously used for screen plates. The thinner material allows for forming more aggressive contours, and makes possible the use of slot cutting techniques other than machining. Thus, thinner material properly formed with new and different slot openings can increase screening efficiency and capacity while retaining or even improving screen plate strength.

With the use of thin material, a laser beam may be utilized to cut openings or slots ranging from 0.004" to 0.020" wide. These openings may be formed in greater lengths than are presently available from currently used machining methods, and this increases the total available open accepts flow area and production rate for a given size screen plate.

The modular design employs a rigid, strengthening pilot back ring and a varying number of mid or support rings and flange rings, all connected by tie rods with the annular screen plates clamped between each ring. This permits various hole and slot combinations within the same assembly. The modular construction provides an inner contour permitting very close foil to plate gap settings. When a given section of the screen plate is damaged or worn out, only that section need to be replaced. The support rings, tie rods, and undamaged and unworn screen plate sections can be reused, thereby substantially reducing costs for repairing worn or damaged screens.

For highly abrasive applications, abrasive resistant inserts can be inserted in the screen plate and retained by the retaining rings of the modular construction. As wear occurs, the inserts can be replaced at much less cost than replacing entire screen plates Other objects, advantages, and features will become more apparent with the teaching of the principles of the present invention in connection with the disclosure of the preferred embodiments thereof in the specification, claims, and drawings, in which:

BRIEF DESCRIPTION OF THE DRAWINGS

FIG. 14 is a top plan view of yet another modified slot which may be used in screen plates of the present invention.

FIG. 15 is a top plan view of a screen plate embodying the present invention, and further showing two types of hole configurations that may be utilized.

FIG. 16 is a cross-sectional view through the screen plate shown in FIG. 15, taken along line XVI—XVI of FIG. 15.

FIG. 17 is a cross-sectional view of the screen plate shown in FIG. 15, taken along line XVII—XVII of FIG. 15.

FIG. 18 is a cross-sectional view through an apparatus for forming the screen plate sections of the present invention, showing one particular configuration therefore.

FIG. 19 is a cross-sectional view through the apparatus shown in FIG. 18, but depicting a subsequent step to that shown in FIG. 18.

FIG. 20 is a cross-sectional view similar to that shown in FIG. 18 and 19, but showing a third step in the forming process.

FIG. 21 is a cross-sectional view similar to that of the previous three drawings, but showing a fourth step in the forming process.

FIG. 22 is a cross-sectional view through an alternate embodiment of forming apparatus, to create the same configuration for the screen plate sections shown in FIGS. 18–21.

FIG. 26 is a cross-sectional view similar to FIGS. 22 through 25, but showing a fifth step in the forming process.

FIG. 27 is a cross-sectional view similar to FIGS. 22 through 26, but showing a sixth step in the formation process FIG. 28 is a cross-sectional view through an apparatus for forming a corrugated screen plate section embodying the present invention, which apparatus simultaneously forms louvered slots similar to those shown in FIG. 16, while the corrugations are being formed.

FIG. 29 is a cross-sectional view through a modified form of a screen plate section embodying the present invention.

FIG. 30 is a cross-sectional view through the screen plate section shown in FIG. 29, taken along line XXX—XXX of FIG. 29.

FIGS. 31 through 35 are views similar to that of FIG. 30, but showing modified forms of the screen plate inserts shown in FIG. 30.

FIG. 36 is a cross-sectional view through a mounting ring and two screen plate sections embodying the present invention, showing the mounting of the apparatus shown in FIG. 29.

FIG. 37 is a cross-sectional view through a mounting ring and two screen plate sections embodying the present invention, but showing a modified mounting slot and corresponding formation for the top of the screen plate section.

FIG. 38 is a cross-sectional view similar to FIG. 37, but showing a further modification of the mounting slot and the edge of the screen plate section.

FIG. 39 is a cross-sectional view similar to FIGS. 37 and 39, but showing a still further modified embodiment of the mounting slot and the edge of the screen plate sections

DESCRIPTION OF THE PREFERRED EMBODIMENTS

Figure 1:
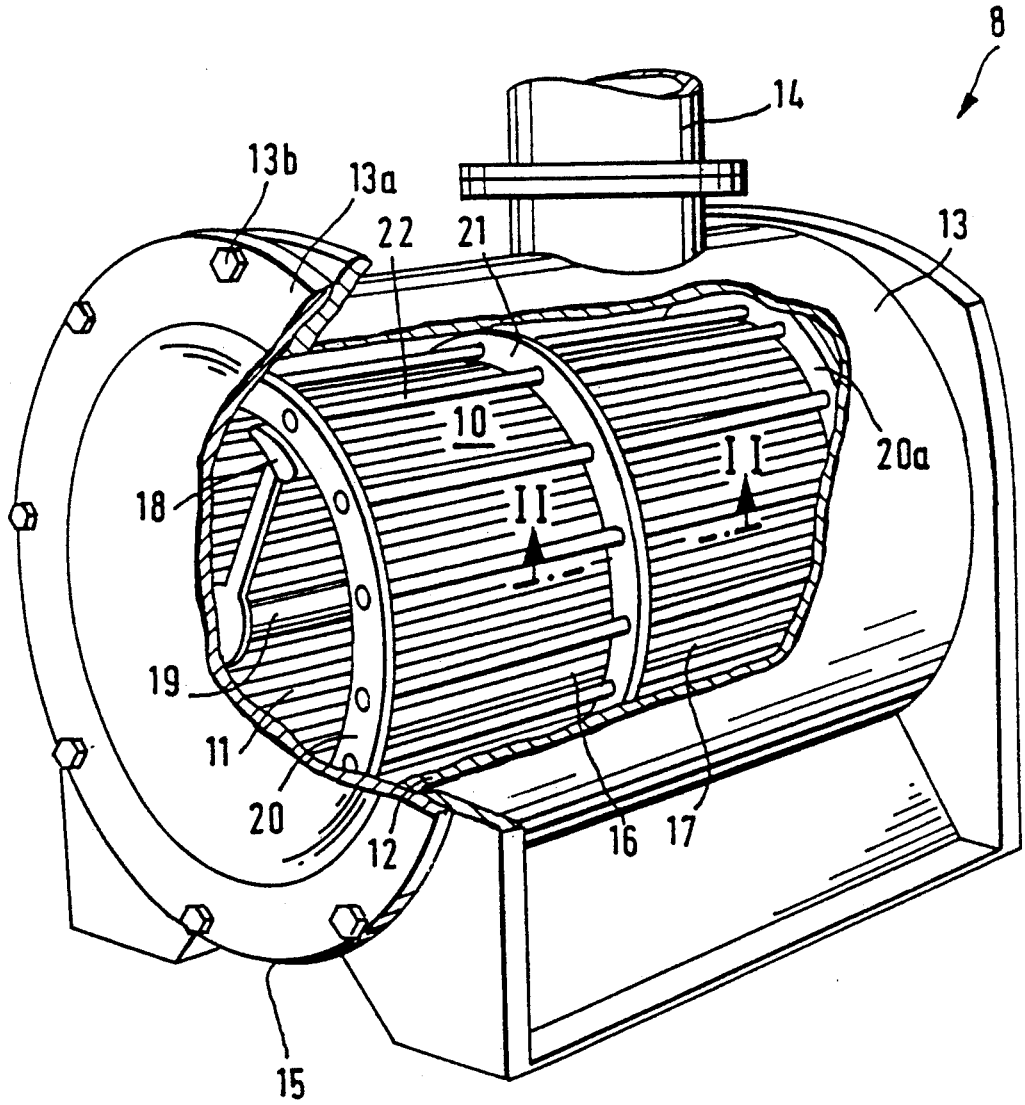
FIG. 1 is a perspective view, with portions broken away, illustrating a pulp screen structure utilizing a screen plate constructed in accordance with the principles of the present invention.

FIG. 1 illustrates a screening apparatus 8 wherein previously treated pulp is screened to remove foreign elements such as sheaves, bark, knots, particles of wood, dirt, glass, plastic, and the like. A screen plate assembly is shown at 10, defining in the apparatus 8 an interior chamber 11 where the pulp to be screened flows in and an exterior chamber 12 where the screened pulp flows out after passing through the screen plate assembly. The assembly is enclosed in a housing 13 which has an inlet, not shown, for the entrance of pulp to be screened into the chamber 11, and an outlet, not shown, leading from the chamber 11 for the foreign material such as the sheaves, bark, and dirt. The accepted pulp flows out through an outlet 14.

The screen plate assembly 10 is stationary within the housing 13, and for aid in passing the liquid stock with pulp through the screen plate, and to help inhibit plugging, hydrofoils 18 are mounted for rotation within the cylindrical screen plate assembly. The hydrofoils 18 are supported on arms of a rotary driven shaft 19, and rotates in a clockwise direction, as viewed in FIG. 1. The hydrofoils shown are merely illustrative of a suitable type, and it should be understood that the present invention can be used for screen plates of various types for various pulse, turbulence and combination pulse and turbulence generating rotors.

The screen plate assembly 10 includes cylindrical screen sections 16 and 17 which, without support, are essentially flexible and require rigidifying or strengthening for use in the pressurized environment of screen apparatus 8. The necessary support and strengthening is provided by end rings 20 and 20a and intermediate support ring 21. Each of the rings has grooves, such as illustrated by the grooves 23 and 24 in the ring 21 shown in FIG. 2. The grooves 23 and 24 are circular to hold the screen sections in a substantially cylindrical shape. The grooves 23 and 24 have a radial dimension substantially equal to the radial thickness of the shaped screen plates.

The screen plates are formed from relatively thin material compared to the heretofore known machined screen plates. The thin material is formed into various shapes or contours, generally undulated, so as to present a substantial amount of screening area to the stock. FIGS. 5 through 10 illustrate contours which may be used, and which are capable of attainment with the structure and manufacturing methods of the present invention.

Figure 2:
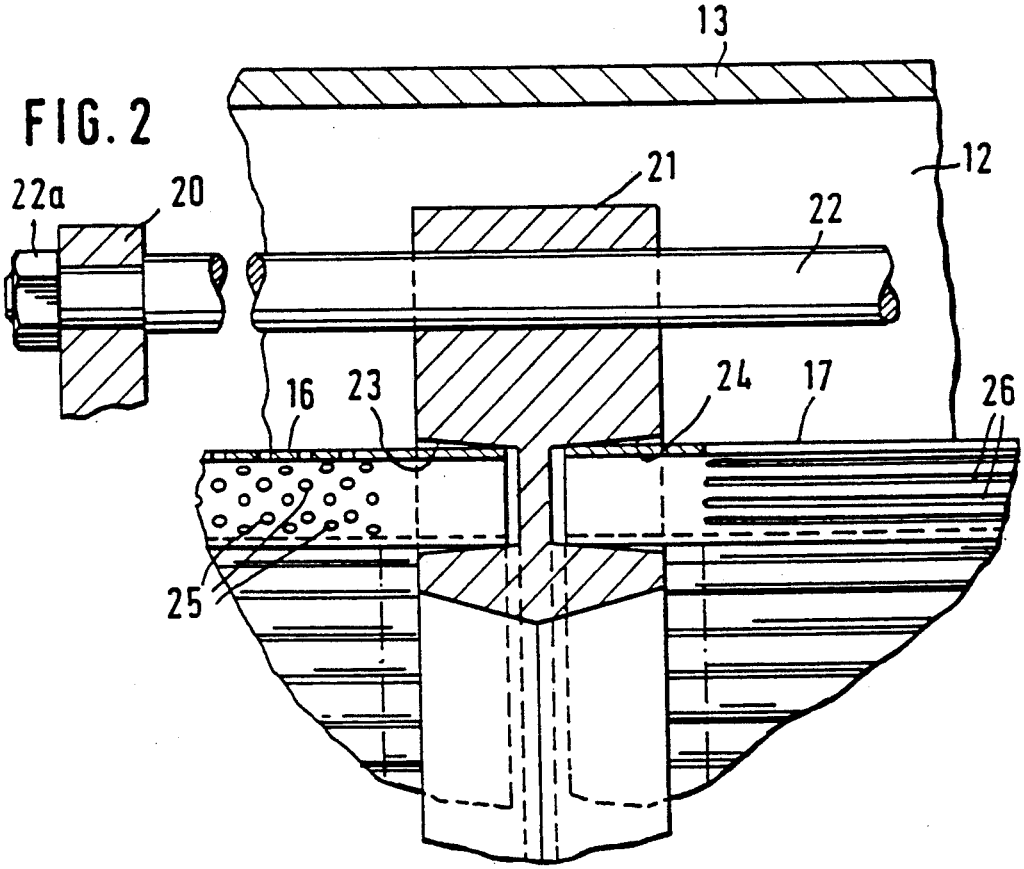
FIG. 2 is an enlarged, fragmentary, sectional view taken substantially along line II—II of FIG. 1.

During assembly, each of the shaped screen plates is positioned into the grooves in the end ring 20 or 20*a* and the intermediate ring 21, and the rings are pulled together to force the screen plates into the grooves. For this purpose, axially extending rods 22 are provided, spaced circumferentially from each other, and the rods are provided at their ends with threads and nuts 22*a* so that the nuts can be tightened to pull the end rings toward each other and force the ends of the screen plates into the grooves. The grooves are preferably tapered so that the slot becomes narrower in an inward direction toward the bottom of the groove, as indicated by the illustration of FIG. 2. When the rods are tightened, the screen plates are pushed tightly into the tapered grooves so that the screen plates are held firmly in a fixed position, circumferentially. With screen assemblies of different lengths, the screens can be longer or shorter, or even greater in number, and additional reinforcing intermediate rings such as 21 may be employed between the ends of each of the adjacent screens.

Figure 3:
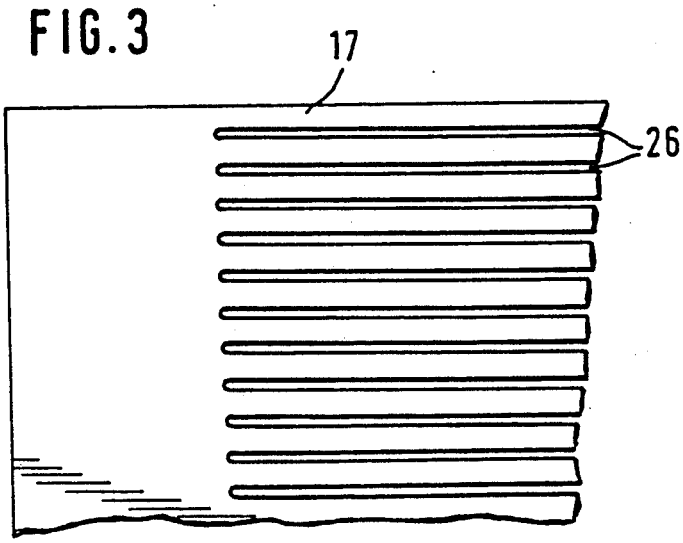
FIG. 3 is a detailed, fragmentary, sectional view portion of the screen plate.
Figure 4:
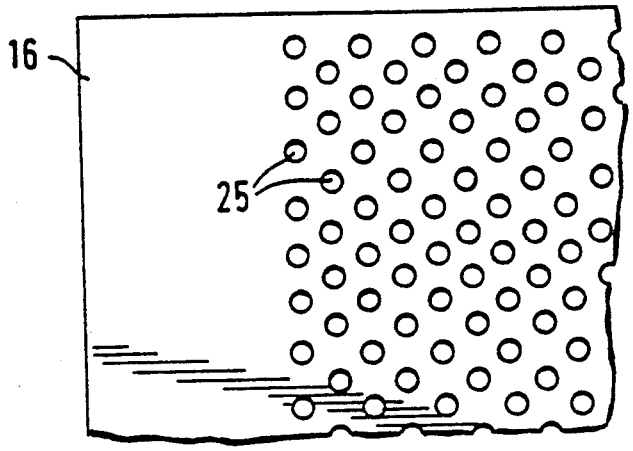
FIG. 4 is another fragmentary, enlarged, plan view of a screen plate, similar to FIG. 3, but of a different design insofar as the screen openings are concerned.
Figure 5:
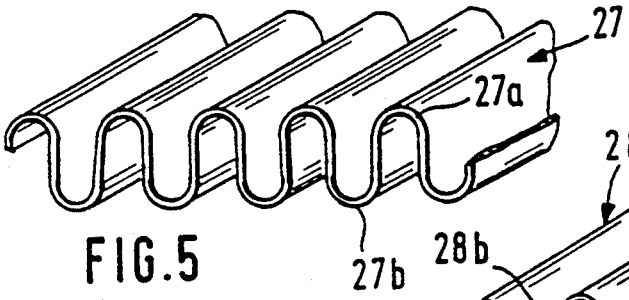
FIG. 5 is a perspective view of a portion of screen plate showing a form of plate contour that may be employed.

Screening openings such as 25 and 26 extend through the thin, screen material, as indicated by the screens 16 and 17 shown in FIGS. 2, 3, and 4. Depending upon the types of stock to be screened and the specific problems of screening, different combinations of slots or holes may be employed, and the thin material used in the present screen plate assembly can be provided with holes or slots of different sizes and shapes through manufacturing techniques, including the use of laser beam cutting, or other hole forming processes such as punching. The holes or slots may be created before, during, or after the formation of the undulations in the sheet-like material The slots may range from 0.004" to 0.02" wide and be in greater lengths than presently possible, wherein screen plate openings are formed by machining processes. The variety of sizes and lengths of openings that can be formed in a screen made of thin material can substantially increase the total available open accepts flow area of the screen, and thereby increase the production rate for a given size screen plate.

The present modular design employing one or more mid or support rings, such as shown at 21, and end rings, such as shown at 20 and 20*a*, allows for use of screen sections of different lengths and with different hole and slot combinations. Any number of sections of any length may be used, and a wide variety of combinations of slot sizes and shapes, as well as screen plate contours, can be provided in a single screen. If wear or damage to any of the cylindrical screen sections occurs, the section can be replaced by loosening the axial tie rods and replacing or exchanging the section. This also enables replacement with substitute sections of different hole or slot arrangements so that, with a given piece of screening machinery, different screening operations can be achieved through easy replacement of screen sections. As will be seen from the drawing of FIG. 1, access to the interior of the housing 13 is readily afforded by removal of the end plate 13*a* through removal of the bolts 13*b*. This permits withdrawal of the screen assembly for ready exchange or replacement of the screen sections.

The thin material of the screen sections may be stainless steel or similar sheet metal which is formed in a generally cylindrical shape having undulations extending around the circumference of the screen. In a simplified form, the undulations shown in FIG. 5 may take the form of a series of upright and inverted U-shaped sections 27*a* and 27*b*, or, in other words, the screen essentially consists of a series of deep corrugations.

Figure 6:
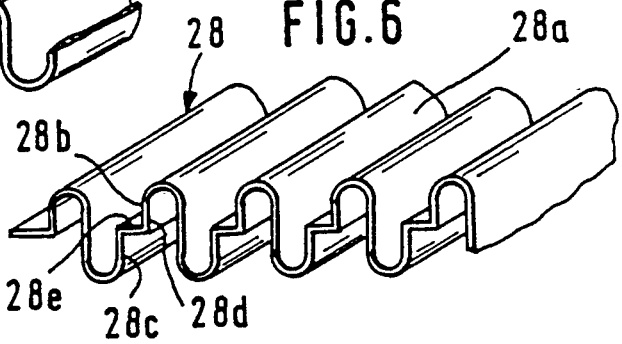
FIG. 6 is a fragmentary, perspective view illustrating another form of contour that may be employed for a screen plate.

These corrugations may be modified as illustrated in FIG. 6 by a shaping of the U-shaped sections, and as illustrated in FIG. 6, the U-shaped section may be formed so that one sidewall 28*a* of the U is a straight, substantially radial wall, whereas the other wall 28*b* has lower and upper straight portions 28*c* and 28*d* joined by a circumferential flat wall portion 28*e*. The flat wall portion may perform an additional filtering br screening function and may include the same or different perforations than the remainder of the screen. The flat, part circumferential portion also adds circumferential rib strength to the overall screen.

Figure 7:
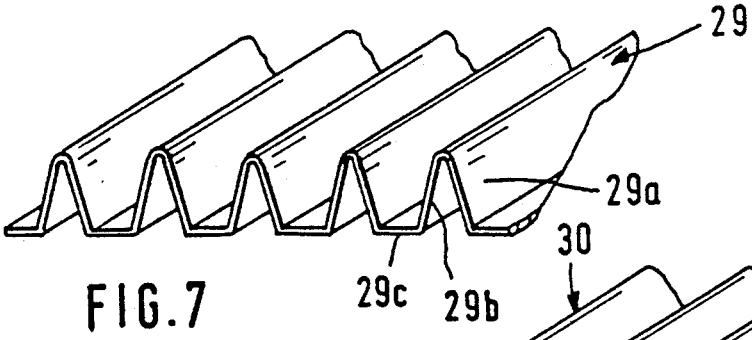
FIG. 7 is a fragmentary, perspective view illustrating still another contour of screen plate that may be employed.

In the arrangement of FIG. 7, the undulations take the form of outwardly extending V-shaped ridges 29 having side walls 29*a* and 29*b*. The inner base of the side walls is joined by a flat, generally partially circumferentially extending planar portion 29*c*. Again, all of the areas may supply screening openings and strengthen the screen structure.

Figure 8:
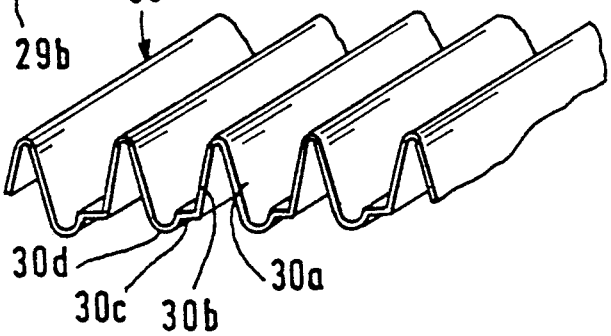
FIG. 8 is a fragmentary, perspective view illustrating still another contour of screen plate that may be employed.

In the arrangement of FIG. 8, the screen is formed by a series of ridges 30 with planar side walls 30*a* and 30*b*. At the base of one side wall 30*b* is a generally part circumferentially extending planar portion 30*c* which is joined to a curved base 30*d*. This arrangement functions to provide additional strength and screening area.

Figure 9:
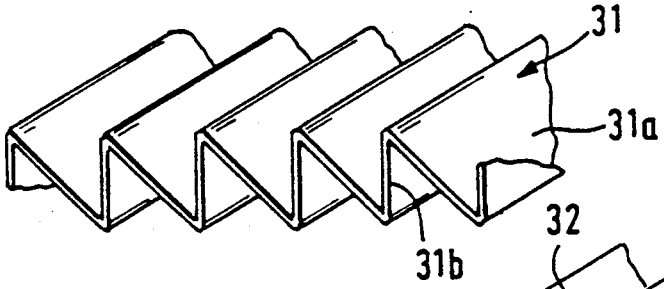
FIG. 9 is a fragmentary, perspective view illustrating a still further contour of screen plate that may be employed.

FIG. 9 illustrates a screen formed of a series of ridges 31, with the ridges having side walls 31*a* and 31*b* of unequal length so that the angular slope of the side wall 31*a* is less than the slope of the side wall 31*b*. This again provides strength and provides a good cleaning effect relative to the hydrofoil which is moved past the inner surface of the curved screen.

Figure 10:
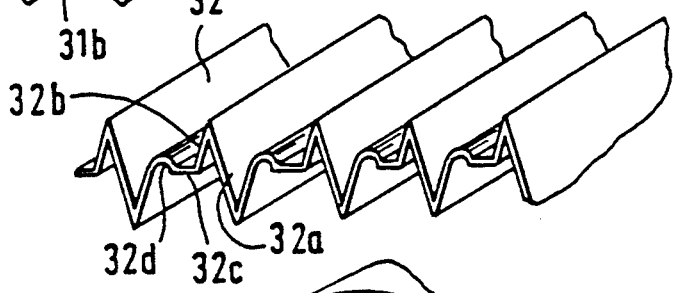
FIG. 10 is a fragmentary, perspective view illustrating a further contour of screen plate that may be employed.

FIG. 10 illustrates a screen formed with a series of ridges 32, each having one flat side wall 32*a* with a shorter opposing side wall 32*b*. At the base of the shorter side wall is a flat, generally partly circumferentially extending portion 32*c* which joins a radially outwardly extending U-shaped portion 32*d*.

As will be observed from FIGS. 5 through 10, the substantial variety of screen shapes that can be accomplished exceeds that of shapes heretofore available. While a number of screen shapes or profiles have been shown in FIGS. 5 through 10, shapes other than those shown may also be used advantageously. Those shown are not intended to be limiting on the shapes useful in the present invention, but are merely representative of some useful shapes. The screen shapes can be achieved with a press forming apparatus handling the relatively thin screen material at a relatively minimal manufacturing cost relative to a procedure which requires substantial machining.

Under previously known screen plate manufacturing techniques, there are geometric limitations on the openings that can be provided in the screen plate, in an attempt to maximize the open flow area and to provide slotted arrangements. As a result of the modular, reinforced structure of the present screen plate assemblies, which allows utilization of relatively thin material, other slot forming processes are available. For example, laser burning and punching are not practical with the relatively-thick walled screen plates used previously, but do work well with the relatively-thin walled screen plates of the present invention. Thus, flow area can be maximized by laser cutting a variety of nonlinear-type openings in the screen plate. By way of example, several openings are shown in FIGS. 11 through 17 which may be utilized. It should be recognized that a virtually infinite variety of shapes and sizes other than those illustrated can also be used.

Figure 11:
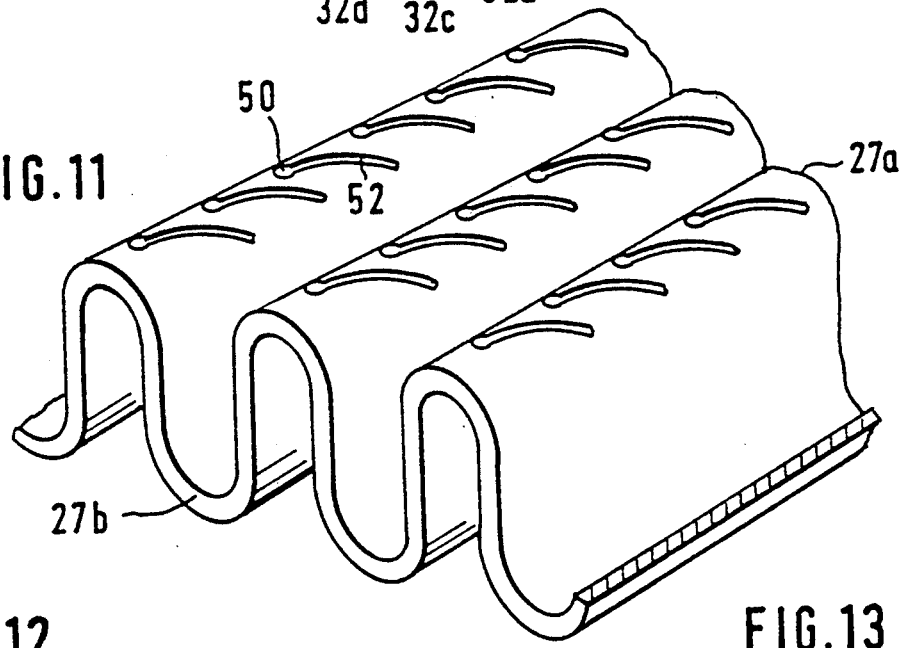
FIG. 11 is an enlarged perspective view of a portion of a screen plate embodying the present invention, and showing a particular slot configuration in the screen plate.

FIG. 11 shows, perspectively, screen plate openings having a generally circular portion 50 with a linear portion 52 extending therefrom. These openings are shown in a top plan view in FIG. 12.

Figure 12:
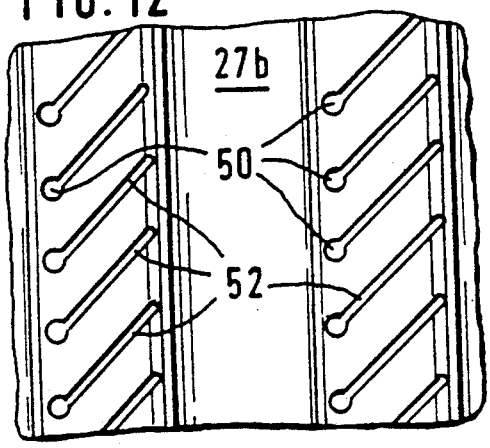
FIG. 12 is a top plan view of the screen plate portion shown in FIG. 11.
Figure 13:
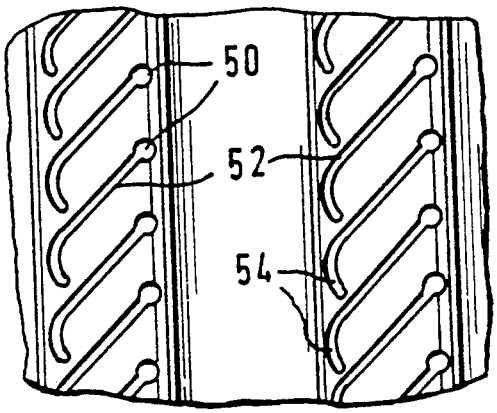
FIG. 13 is a top plan view of a modified form of the screen plate shown in FIG. 12, showing a modification of the slot shown in FIG. 12.
Figure 23:
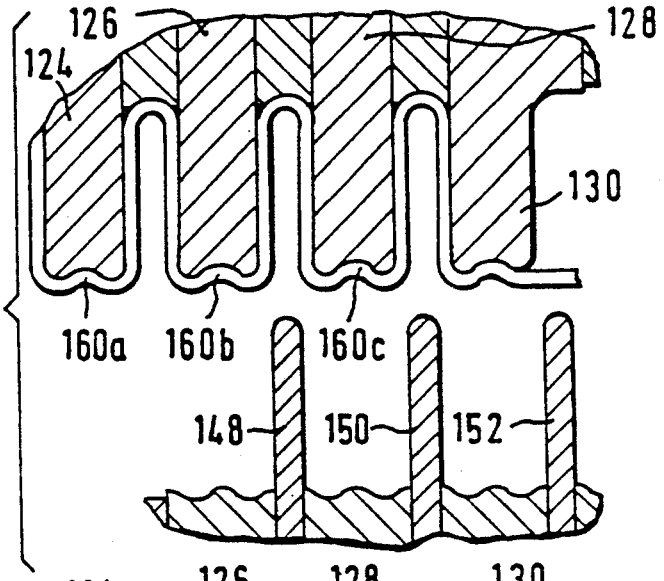
FIG. 23 is a cross-sectional view similar to FIG. 22, but showing the second step of the forming process

FIG. 13 illustrates a modification of the openings shown in FIGS. 11 and 12, in which a curved portion 54 is provided opposite the circular portion 50 on the linear section 52.

In FIG. 14, a zig-zag opening 56 is illustrated, which may extend substantially the entire length of a screen plate section, or may be provided in a series of patterns along the length of the screen plate section Further, slotted profile arrangements may be provided to achieve aggressive or agitative profiles which enhance full performance. Several of these are shown in FIGS. 15, 16, and 17. In FIG. 15, louvered openings 58 are shown, in which a dome 60 is raised upwardly from the opening 62. In yet another embodiment of opening shown in FIG. 15, a flap 64 is left between two substantially parallel slot openings 66 and 68, which are joined at 70. Thus, the flap 64 is attached at only one end and is otherwise defined by the slot openings 66, 68, and 70.

Either of the embodiments shown in FIG. 15 can be readily formed by piercing or punching techniques to be described subsequently herein. The various openings can be used individually or in combination on a single screen plate section, or in a plurality of sections in a single screen apparatus. In some applications of the screen baskets embodying the present invention, electrical, mechanical, or chemical polishing may be utilized to enhance the hydraulic capacity or throughput of the slotted surface. However, one of the advantages of the present invention is that the strengthening provided by the modular structure allows the use of thin material which can be formed gently by bending Therefore, highly polished metals can be used and the need for subsequent polishing and cleanup of the finished screen plate is minimized or even eliminated.

In operation, as illustrated in FIGS. 1 and 2, a series of cylindrical screen sections 16 and 17 are provided, each with perforations therethrough, such as illustrated in the forms of FIGS. 3 and 4. The sections used in any screen may be identical, or the openings and/or profiles of the sections may be different. The circumferential sections are supported by end rings 20 and 20*a* and intermediate rings 21 which have tapered grooves such as 23 and 24 for receiving the ends of the screens. The screen plate is assembled by positioning the individual sections in the appropriate rings and inserting the axial rods 22 through the rings. Tightening the nuts 22*a* compresses the assembly and secures the rings and screen sections in place. The completed assembly is mounted in the screen apparatus 8 in conventional manner.

Replacement of any of the screen sections can be quickly accomplished by removing the screen plate assembly 10 from the apparatus 8 and loosening the nuts 22*a* from the axial through rods 22. After freeing the sections form the rings, replacing, or exchanging the screen sections and reconnecting and tightening the rods can be completed quickly. Even if all the screen plate sections are replaced, the cost for doing it is substantially less than for replacing a conventional screen plate in that the rings and through rods of the present invention can be reused for substantial periods of time.

The relatively thin material used for the present screen plates can be formed into a variety of undulated patterns by simple bending and forming techniques. FIGS. 18 through 21 show a four step forming process within a forming machine. The forming machine includes top and bottom forming units 80 and 82, respectively, each having some discrete and individually operating portions thereof, to be described subsequently. The individual portions advance independently by means of pneumatic, hydraulic, or other actuators which will be well known to those versed in the art.

As shown in FIG. 18, the forming machine has a bottom support member 84 and upwardly extending interlocking male members 86 and 88. As will be apparent from the following description, the interlocking members 86 and 88 may be stationarily mounted in the supporting member 84. The shape being formed by the apparatus depicted in FIGS. 18 through 21 includes a relatively narrow, generally U-shaped section 90 and a relatively wider modified W-shaped section 92. The interlocking member 86 extends into the last completely formed narrow section 90. A first forming section 94 from the upper unit 80 is advanced into the last completely formed wider section 92, and interlocks the material therein between it and the interlocking members 86 and 88. In some aspects, it can be stated that the upwardly extending interlocking male members 86 and 88 define between them a female member for receiving the first forming section 94.

As shown in FIG. 19, a second forming section 96 from the upper unit 80 advances downwardly towards the lower unit, and completes the formation of a second generally narrow shaped section 90*a*. Thus, the forming sections 94 and 96 define between them a female section for receiving the interlocking member 88 of the lower unit. At the same time, the bottom portion of the next generally wider section 92*a* is formed. Clearance between adjacent surfaces of the upper and lower units when positioned as in FIG. 19, is not substantially greater than the thickness of the material being formed.

As shown in FIG. 20, after the formation shown in FIG. 19 is completed, a preformer including an upper section 100, a bottom section 102, and a side section 104 is advanced to generally shape the material into a predetermined pattern which aids the subsequent forming process, and ensures that the material being formed is shaped into the desired undulating pattern, rather than being pulled or stretched, thereby minimizing the generation of built-in stresses.

After the preforming is completed, all forming sections are retracted, and the material is advanced through the machine such that the forming process depicted in FIG. 18 can be repeated. That is, the last formed section 90*a* is advanced to the position previously occupied by the section 90, generally covering the interlocking piece 86.

An alternate forming process and apparatus therefore is shown in FIGS. 22 through 27. The forming apparatus again includes a top section 120 and a bottom section 122 for creating a contoured pattern similar to that shown in FIGS. 18 through 21. The various parts of the upper and lower sections do not move individually. Each section moves as a unit.

The top forming unit 120 includes generally wider male forming fixtures 124, 126, 128, and 130. Disposed between the male fixtures are the generally narrower shaped female fixtures 132, 134, and 136. The bottom forming unit includes complimentary fixtures, including generally wider female fixtures 140, 142, 144, and 146; and generally narrower male fixtures 148, 150, and 152.

Figure 25:
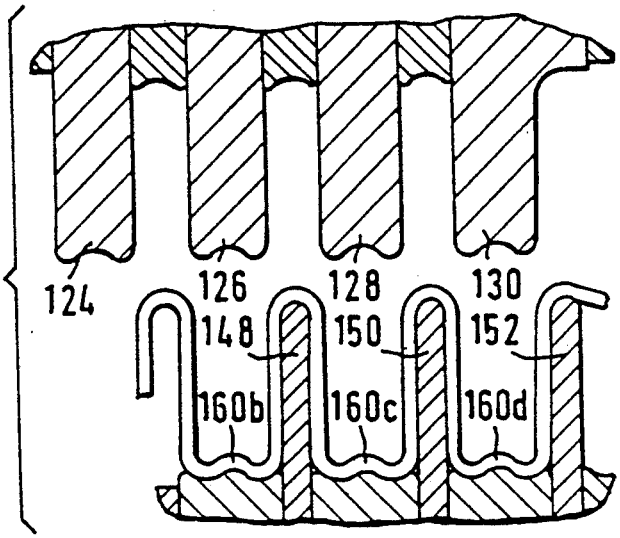
FIG. 25 is a cross-sectional view through a forming apparatus similar to those of the previous three drawings, but showing a fourth step in the forming process.

In FIG. 25, the top and bottom forming units have again moved apart vertically. In FIG. 26, the top forming unit has moved one pattern back to the right. In FIG. 27, the top and bottom units have again closed, thereby forming yet another of the undulating patterns.

Figure 24:
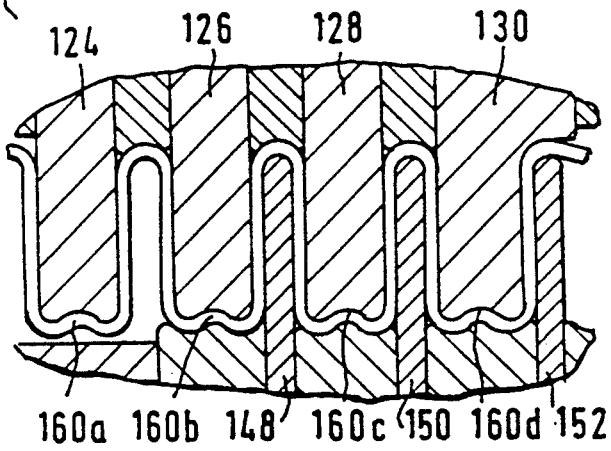
FIG. 24 is a cross-sectional view similar to the previous two drawings, but showing a third step in the formation process.

For sake of clarity, several of the patterns have been numbered in the drawings, and the movement of the patterns is readily apparent. Thus, the patterns previously formed, prior to the operation shown in FIG. 22, have been designated with numerals 160*a*, *b*, and *c* in FIG. 22. In FIG. 24, a new pattern 160*d* has been formed, and in FIG. 27, yet another pattern 160*e* has been formed.

In the operation of a forming apparatus and method as described for FIGS. 22 through 27, the material being formed will alternately stay with the top and bottom forming units as the patterns are formed. Thus, in FIG. 22, the material has remained on the top unit as the bottom unit is retracted, and as the top unit advances to the left. In FIG. 25, the material is shown to have stayed with the bottom unit as the top unit is retracted and moved to the right, prior to the formation shown in FIG. 27. At completion of the step shown in FIG. 27, the procedure repeats again with the step as shown in FIG. 22.

By changing the shape of the forming tools used, any number of different shapes or patterns may be formed, which may enhance the hydraulic capacity or throughput of a given screen plate, depending upon its application. For example, the patterns shown in FIGS. 5 through 10, as well as a variety of other patterns, can easily be formed in the relatively thin material through the press forming techniques shown generally in FIGS. 18 through 27.

Another advantage obtained from using the relatively thin material that can be employed advantageously in screen plates of the present invention is that the hole or slot forming process can be incorporated with the undulating pattern forming process. For example, in FIG. 28, a press forming operation is shown for forming the pattern generally shown in FIG. 11, and incorporation a punch dye 170 for forming the louvered openings shown in FIGS. 15 and 16. Such a formation process greatly simplifies and reduces the cost for forming the screen plate sections, thereby obtaining even greater financial advantages for screen plate manufacture.

The manufacturing and assembly methods of the present invention make possible other modification for specific applications. For example, when the slurry being screened is high in abrasive contaminants, such as metals, sand, plastic, and glass often found in recycling wastepaper, conventional screen plates wear out rapidly. The modular design of the current screen plates permits the use of highly abrasive-resistant inserts in the screen plate. In FIG. 29, inserts 180 and 182 are shown disposed in the corrugation or undulations 184 and 186 of the inlet side of the screen plate. The modular design incorporating clamping rings will also clamp the abrasive-resistant inserts in place, along with the screen plate sections. Further, the modular design also permits replacement of worn or damaged inserts as needed. Therefore, if one or several inserts become severely damaged due to a large contaminant, only those inserts need to be replaced. Alternatively, the entire set of abrasive resistant inserts can be replaced without replacing the rings, tie rods, or even the screen plate; which may be reused.

Additionally, by varying the shape of the top of the insert which is exposed to the material to be screened, a secondary aggressive profile or shape can be produced. It is possible to further increase the hydraulic capacity or throughput of a given screen plate by the use of inserts, whether or not the inserts are used for abrasion resistance. FIGS. 30 through 35 illustrate a variety of different tip shapes, indicated by numerals 190, 192, 194, 196, 198, and 200 that can be useful in screening different materials. FIG. 36 further illustrates the mounting of screen plate sections 204 and 206 with inserts 180 and 280 in the central mounting ring 202. Each insert is similarly secured at its opposite end in the end ring or support member.

The screen plate assembly of the present invention is capable of even further modification for particular applications. For example, in FIG. 2, the rings shown project inwardly from the inner surface of the screen plate sections. This geometry limits the minimum gap that can be provided between the screen plate surface and the rotating foil. In some situations, this limitation may deter flow performance and screen output. Therefore, when minimal screen to rotor gap is required, the mounting means for the screen can be modified. FIG. 37 through 39 illustrate modifications for use with minimal clearance screens. A secondary forming operation to the corrugation formation, wherein the edges are crimped, can be utilized, thereby allowing the screen plate's inner contour to blend with the mounting rings, and allowing closer plate to rotor gap settings.

In FIG. 37, the mounting ring 210 includes grooves having bottoms 212, straight sides 214 and angular surfaces 216. The screen plate sections at their edges have angular shapes complementary to the mounting ring grooves.

In FIG. 38, the ring 220 includes grooves having substantially axially horizontal sections 222 opposite the sides 214 and an angular section 224. The edge of the screen plate sections are crimped correspondingly.

In FIG. 39, the mounting ring 230 includes grooves having generally arcuate shaped sections 232, and again the edge of the screen plate sections are crimped correspondingly.

It can be seen that any of the shapes illustrated in FIGS. 37, 38, and 39; as well as a variety of other shapes can be utilized to maintain the rigid and stationary mounting within the mounting rings, while offsetting the screen plates so that the inner surface of the rings and the inner surface of the plates correspond, thereby not limiting the minimum gap allowable between the rotor and the screen plate inner surfaces.

The present invention achieves many desirable objectives for screen plate design. The modular construction permits wide flexibility in screen plate shape, hole or slot formation, and screen plate utilization. Manufacturing and maintenance costs are significantly reduced in that the manufacturing techniques which can be used are less expense than those previously used for the necessary thick-walled screen plate material for previous designs. Replacement due to damage, failure, or alternate operation can be limited to those parts actually requiring replacement. The screen can readily be adapted to different uses by adapting the shape of slot opening, and by the use of inserts for wear resistance or increased aggressiveness of the surface contour.

While the present invention has been broadly described herein, including a wide variety of modified embodiments, it should be recognized that additional modified embodiments may be made without departing from the scope of the present invention.

We claim:

1. A method for making a modular screen plate for use in a pulp pressure screening apparatus, said method comprising:

forming undulations in relatively thin sheet material by bending;

shaping said formed sheet material into a generally cylindrical shape;

creating openings through said material;

placing rigid support members at opposite ends of said cylindrically shaped material; and securing the position of said rigid support members relative to each other by fastening therebetween releasable tieing members.

2. The method for making a screen plate as defined in claim 1, in which said step of creating openings is performed by a punch.

3. The method for making a screen plate as defined in claim 1, in which said step of creating openings is performed by laser burning.

4. The method for making a screen plate as defined in claim 1, in which said step of forming undulations is performed by complimentary forming members operated on opposite sides of said sheet-like material, bending and forming said sheet-like material into desired undulations without stretching the sheet-like material.

5. A method for making a screen plate as defined in claim 1, in which said step of creating openings is performed before said step of forming undulations.

6. The method for making a screen plate as defined in claim 1, in which said step of creating openings is performed after said step of forming undulations.

7. The method for making a screen plate as defined in claim 1, in which said step of creating openings through said material is performed by punching holes therein, while forming undulations in the sheet material.

* * * * *